United States Patent [19]

Wiklof et al.

[11] Patent Number: 4,604,635

[45] Date of Patent: Aug. 5, 1986

[54] THERMAL PAPER AND METHOD FOR MAKING THERMAL PAPER WITH SILICONE RESIN PROTECTIVE LAYER

[75] Inventors: Christopher A. Wiklof, Mukilteo; Gerald R. Apperson, Seattle; Robert J. Brooks, Woodinville; Robert A. Samuel, Snohomish, all of Wash.

[73] Assignee: Intermec Corporation, Lynnwood, Wash.

[21] Appl. No.: 669,594

[22] Filed: Nov. 8, 1984

[51] Int. Cl.[4] ..... D03D 3/00

[52] U.S. Cl. ..... 346/226; 428/447

[58] Field of Search ..... 428/447; 346/226

[56] References Cited

U.S. PATENT DOCUMENTS

| | | |
|---|---|---|
| 2,900,277 | 8/1959 | Schmitz et al. . |
| 2,910,377 | 10/1959 | Owen . |
| 3,063,872 | 11/1962 | Boldebuck . |
| 3,074,809 | 1/1963 | Owen . |
| 3,076,721 | 2/1963 | Coles et al. . |
| 3,136,637 | 6/1964 | Larson . |
| 3,188,229 | 6/1965 | Graham . |
| 3,437,512 | 4/1969 | Burlant et al. . |
| 3,547,683 | 12/1970 | Williams et al. . |
| 3,650,811 | 3/1972 | Nordstrom et al. . |
| 3,723,167 | 3/1973 | Nordstrom . |
| 3,745,059 | 7/1973 | Kubo et al. . |
| 3,746,567 | 7/1974 | Nordstrom . |
| 3,839,076 | 10/1974 | Miller . |
| 4,042,749 | 8/1977 | Sandvig . |
| 4,052,529 | 10/1977 | Bokerman et al. . |
| 4,085,248 | 4/1978 | Zehender et al. . |
| 4,100,311 | 7/1978 | Nablo et al. . |
| 4,133,939 | 1/1979 | Bokerman et al. . |
| 4,151,158 | 4/1979 | Poddubuy et al. . |
| 4,225,631 | 9/1980 | Berger et al. . |
| 4,246,297 | 1/1981 | Nablo et al. . |
| 4,306,050 | 12/1981 | Koerner et al. . |
| 4,309,713 | 1/1982 | Shimozaki et al. . |
| 4,370,370 | 1/1983 | Iwata et al. . |
| 4,401,721 | 8/1983 | Hida . |
| 4,404,276 | 9/1983 | Steklenski . |
| 4,443,491 | 4/1984 | McIntyre . |

*Primary Examiner*—Edith Buffalow

*Attorney, Agent, or Firm*—Christensen, O'Connor, Johnson & Kindness

[57] ABSTRACT

A thermal recording paper comprising a substrate (12) and a protective layer (20). The substrate includes a support layer (13) and a thermal layer (14) comprising a heat-sensitive, image forming thermal material. The protective layer comprises a cured silicone resin overlying one side of the substrate and positioned on the same side of the support layer as the thermal layer. In another aspect, the present invention comprises a method of making thermal recording paper comprising coating one side of the substrate with a silicone resin such that the silicone resin is positioned on the same side of the support layer as the thermal layer, and curing the silicone resin by exposing it to radiation such as electron beam radiation or ultraviolet radiation.

5 Claims, 1 Drawing Figure

THERMAL PAPER AND METHOD FOR MAKING THERMAL PAPER WITH SILICONE RESIN PROTECTIVE LAYER

FIELD OF THE INVENTION

The present invention relates to thermal printing paper on which images may be formed by selective exposure of the paper to a heated print element.

BACKGROUND OF THE INVENTION

Thermal printing paper typically comprises a support layer coated with a thermally sensitive layer that darkens upon exposure to heat. The heat is applied to the thermal paper by passing the paper under a heated print element mounted in a print head. As the thermal paper is transported past the print head, the thermally sensitive layer is exposed by selective energization and heating of the print element so as to "print" on the thermal paper.

In one type of prior art thermal recording paper, the thermally sensitive layer is the outermost layer of the thermal paper and is in contact with the heated print element during printing. Several problems result from this arrangement. The thermally sensitive layer and the image therein are subject to physical and chemical degradation. Furthermore, the thermally sensitive layer can soften and stick to the print element during printing, thereby interfering with the desired paper movement and generating a significant amount of noise. Contact between the print element and the thermally sensitive layer can also cause portions of the thermally sensitive layer to peel off and leave a residue on the print element. When the thermal paper comprises labels upon which bar code patterns are thermally printed, an additional problem is that repeated scanning of the label by a bar code reading device may eventually degrade the label to a point where the bar code is unreadable or produces an incorrect reading.

In an effort to alleviate some of these problems, certain prior thermal paper and labels have included a protective layer comprising a water soluble polymer coated onto the thermal layer. Examples of prior protective layer ingredients include polyvinyl alcohol and various cellulose derivatives. The use of a protective layer comprising a water soluble polymer does provide some degree of physical and chemical protection for the thermally sensitive layer. However the water soluble polymer also significantly increases the sticking between the thermal paper and the print element during the thermal printing process. Sticking is a particular problem for thermal labels and other thermal papers on which bar code patterns are printed. In a bar code printing process, lines having a length up to two inches or more are printed in a direction transverse to the direction of paper movement past the print element. Sticking between the print element and the thermal paper can therefore result in large net forces that can lead to the sticking problems discussed above or to jamming of the printing apparatus.

SUMMARY OF THE INVENTION

The present invention provides a thermal recording paper coated with a protective layer that eliminates many of the problems associated with prior thermal papers. In particular, the protective layer utilized in the present invention protects the thermal recording paper and in addition reduces sticking between the paper and the print element, thereby reducing unwanted paper movement and the amount of noise generated during printing.

In one embodiment, the thermal recording paper of the present invention comprises a substrate and a protective layer. The substrate includes a support layer and a thermal layer comprising a heat-sensitive, image forming thermal material. The protective layer comprises a cured silicone resin overlying one side of the substrate such that the protective layer is positioned on the same side of the support layer as the thermal layer. In a preferred embodiment, the protective layer is superimposed directly on the thermal layer. The silicone resin may be applied in an amount of up to about 10 pounds of silicone resin per 3,000 square feet of substrate, and preferably in an amount of 0.1–1.5 pounds per 3,000 square feet. In another aspect, the present invention comprises a method of making thermal recording paper. The method comprises coating one side of a substrate that includes a support layer and a thermal layer with a silicone resin such that the silicone resin is positioned on the same side of the support layer as the thermal layer, and curing the silicone resin by exposing it to radiation such as electron beam radiation or ultraviolet radiation.

DETAILED DESCRIPTION OF THE DRAWINGS

Figure 1:
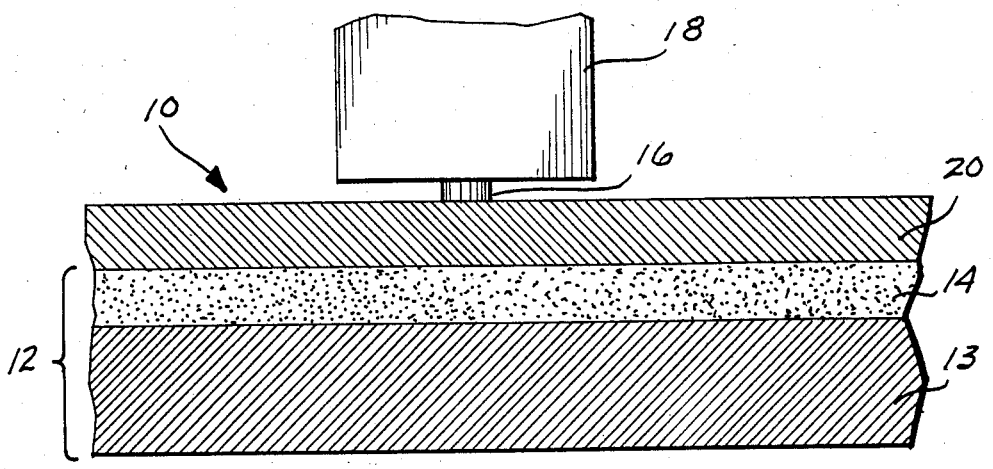
FIG. 1 is a partial cross-sectional view of a thermal recording paper according to the present invention and a portion of a thermal printing apparatus.

FIG. 1 illustrates one preferred embodiment of the thermal recording paper of the present invention. The thermal recording paper 10 includes substrate 12 comprising support layer 13 and thermal layer 14 superimposed on one side of the support layer, and protective layer 20 superimposed on the substrate. Support layer 13 may comprise paper, an adhesive backed label mounted on a backing strip, a synthetic resinous sheet, metal foil, or any other material adapted to receive printed images. Thermal layer 14 comprises any substance capable of forming and retaining an image upon exposure to heat. Suitable materials for thermal layer 14 includes a leuco dye or metallic salt in combination with an acidic material capable of coloring the leuco dye or metallic salt when heat is applied. Protective layer 20, discussed in detail below, comprises a cured silicone resin. FIG. 1 also illustrates a portion of a thermal printing apparatus for forming images on thermal recording paper 10. The printing apparatus comprises print element 16 mounted in print head 18. Energization of print element 16 heats the print element and forms an image in the underlying portion of thermal layer 14.

Protective layer 20 comprises a cured silicone resin. A silicone resin is a polymer principally composed of the siloxane functional units as follows:

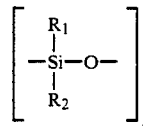

where $R_1$ and $R_2$ are independently selected from hydrogen, alkyl, aryl, hydroxyl or an oxygen atom interconnecting the silicon atom to another silicon atom.

The polysiloxane may be either linear or cyclic. The silicone resin is cured by a curing method that does not involve the application of a significant amount of heat, and does not otherwise produce undesirable side effects in thermal layer 14. The preferred method of curing the silicone resin is to expose the substrate coated with a silicone resin to radiation, preferably electron beam radiation or ultraviolet radiation. As is known to those skilled in the art, radiation curable silicone resins may be formulated from silicone acrylates and methacryaltes, i.e., from polysiloxanes in which $R_1$ and $R_2$ include acrylate and/or methacrylate groups. The acrylate and methacrylate groups render the otherwise unreactive polysiloxane susceptible to cross-linking by exposure to electron beam radiation, or by exposure to ultraviolet radiation in the presence of a suitable photoinitiator.

Application of protective layer 20 to substrate 12 can be performed using any of the standard web application methods that are normally used for coating operations, such as the gravure, offset gravure or flexographic methods. The amount of silicone resin used to form protective layer 20 may vary up to about 10 pounds of resin per 3,000 square feet of substrate. A preferred range for the amount of silicone resin is 0.75–1.5 pounds per 3,000 square feet of substrate. Within such range, protective layer 20 protects thermal layer 14 and reduces sticking between the thermal recording paper and the print element, but does not significantly limit heat flow from the print element to the thermal layer. Above 1.5 pounds per 3,000 square feet, and up to about 10 pounds per 3000 square feet, the increasing thickness of the protective layer provides a diminishing additional degree of protection while at the same time producing an increasing heat path between the print element and the thermal layer. Increasing the thickness of the protective layer also adds to the cost of the resulting thermal recording paper. Above about 10 pounds per 3,000 square feet, the thickness of the protective layer is generally too large to permit effective heating of the thermal layer, and the cost of the protective layer is prohibitive for most applications. Although in principle there is no lower limit to the amount of silicone resin that may be used to form protective layer 20, the practical and therefore preferred lower limit is 0.1 pounds per 3,000 square feet. Below 0.1 pounds per 3,000 square feet, protective layer 20 provides insufficient protection to thermal layer 14 for most uses.

Electron beam curing of the silicone resin may be accomplished by any of several commercially available curing units of either the scanning or nonscanning type. The liquid silicone resin is first coated onto the substrate as described above, and the coated substrate is then moved past a stationary source of electrons while being maintained in an inert (nonoxidizing) atmosphere such as carbon dioxide or nitrogen. When the electrons pass through the silicone resin, some of them react with the aforementioned acrylate or methacrylate groups to initiate a cross-linking reaction. In an ultraviolet curing process, an appropriate free radical photoinitiator is intermixed with the silicone resin, the resin/photoinitiator mixture is coated onto the substrate, and the coated substrate is then moved past a source of ultraviolet radiation. For electron beam curing, the required radiation dose is typically in the range of 0.5–10 MRAD. For curing by ultraviolet radiation, the required radiation dose is typically 200–600 watts/inch provided by mercury vapor lamps with the web moving at 100–300 feet/minute. Both curing methods are well known to those skilled in the art.

Protective layer 20 results in a thermal recording paper having significant advantages over prior thermal papers. As indicated in FIG. 1, the upper surface of thermal recording paper 10 is in contact with the heated print element during printing. As a result, the thermal recording paper is subject to physical degradation by the print element. Protective layer 20 serves to protect thermal layer 14 from such degradation and also from chemical degradation. In addition, it has been found that the sticking between the thermal recording paper of the present invention and the print element does not increase as a result of the printing operation, i.e., as a result of the heating of the thermal recording paper by the print element. With prior thermal papers, the increased sticking force due to printing was often sufficient to cause erratic paper movement and severe printing errors.

While the preferred embodiments of the invention have been illustrated and described, it should be understood that variations will be apparent to those skilled in the art. For example, the protective layer need not be applied directly to the thermal layer, but can instead be applied such that it overlies one or more intervening layers that are applied over the thermal layer. An example of such a thermal recording paper would be a paper in which a water soluble polymer was superimposed on the thermal layer, and a protective layer comprising a cured silicone resin was then applied to the water soluble polymer. Accordingly, the invention is not to be limited to the specific embodiments illustrated and described, and the true scope and spirit of the invention are to be determined by reference to the following claims.

The embodiments of the invention in which an exclusive property or privilege is claimed are defined as follows:

1. A thermal recording paper comprising a substrate that includes a support layer and a thermal layer comprising a heat-sensitive, image forming material, and a protective layer comprising a cured silicone resin overlying one side of the substrate, the protective layer being positioned on the same side of the support layer as the thermal layer.

2. The thermal recording paper of claim 1, wherein the protective layer is superimposed directly on the thermal layer.

3. The thermal recording paper of claim 1, wherein the protective layer comprises up to 10 pounds of silicone resin per 3,000 square feet of substrate.

4. The thermal recording paper of claim 1, wherein the protective layer comprises 0.1–1.5 pounds of silicone resin per 3,000 square feet of substrate.

5. The thermal recording paper of claim 1, wherein the silicone resin comprises a polysiloxane that includes functional units selected from the group consisting of acrylates and methacrylates.

* * * * *